US008363847B2

(12) United States Patent
Deguara et al.

(10) Patent No.: US 8,363,847 B2
(45) Date of Patent: Jan. 29, 2013

(54) DEVICE AND METHOD FOR SIMULATION OF WFS SYSTEMS AND COMPENSATION OF SOUND-INFLUENCING PROPERTIES

(75) Inventors: Joachim Deguara, San Jose, CA (US); René Rodigast, Tautenhain (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 1044 days.

(21) Appl. No.: 12/279,017

(22) PCT Filed: Jan. 17, 2007

(86) PCT No.: PCT/EP2007/000385

§ 371 (c)(1),
(2), (4) Date: Jan. 22, 2009

(87) PCT Pub. No.: WO2007/101498

PCT Pub. Date: Sep. 13, 2007

(65) Prior Publication Data

US 2009/0220111 A1 Sep. 3, 2009

(30) Foreign Application Priority Data

Mar. 6, 2006 (DE) ..... 10 2006 010 212

(51) Int. Cl.
*H04R 29/00* (2006.01)

(52) U.S. Cl. ..... 381/92; 381/17; 381/118; 381/122; 381/300

(58) Field of Classification Search ..... 381/17, 381/92, 122, 300

See application file for complete search history.

(56) References Cited

U.S. PATENT DOCUMENTS

| | | | | |
|---|---|---|---|---|
| 5,657,349 | A | 8/1997 | Sugiyama | |
| 2003/0097257 | A1 | 5/2003 | Amada et al. | |
| 2004/0223620 | A1 | 11/2004 | Horbach et al. | |
| 2005/0123149 | A1 * | 6/2005 | Elko et al. | 381/92 |
| 2005/0280519 | A1 | 12/2005 | Nagata | |
| 2006/0092854 | A1 | 5/2006 | Roder et al. | |
| 2006/0109992 | A1 | 5/2006 | Roeder et al. | |
| 2006/0262939 | A1 | 11/2006 | Buchner et al. | |

FOREIGN PATENT DOCUMENTS

| | | | |
|---|---|---|---|
| EP | 1 209 949 | A1 | 5/2002 |
| JP | 08-079137 | A | 3/1996 |
| JP | 2003-087893 | A | 3/2003 |
| JP | 2003-223198 | A | 8/2003 |

(Continued)

OTHER PUBLICATIONS

English translation of Official Communication issued in corresponding Japanese Patent Application No. 2008-557604, mailed on Mar. 22, 2011.

(Continued)

*Primary Examiner* — Lynne Gurley
*Assistant Examiner* — Vernon P Webb
(74) *Attorney, Agent, or Firm* — Keating & Bennett, LLP

(57) ABSTRACT

An aliasing correction in a wave field synthesis system is achieved by ascertaining the aliasing filter property specific for a virtual source. This aliasing filter property, which, for example, may be the aliasing frequency is ascertained by help of the source position information. This aliasing filter property is used for an adaptive anti-aliasing filter for adaptive filtering of the audio signal associated with the source or the component signals associated with the source.

13 Claims, 7 Drawing Sheets

FOREIGN PATENT DOCUMENTS

| | | | |
|---|---|---|---|
| JP | 2006-005868 | A | 1/2006 |
| WO | 2004/103025 | A1 | 11/2004 |
| WO | 2005/046194 | A1 | 5/2005 |

OTHER PUBLICATIONS

Official communication issued in counterpart International Application No. PCT/EP2007/000385, mailed on May 2, 2007.
Corteel: "Techniques D'Egalisation Pour La Reproduction Sonore," XP002429162; Dec. 9, 2004; pp. 115-179.
Bruijn et al.: "Subjective Experiments on the Effects of Combining Spatialized Audio and 2D Video Projection in Audio-Visual Systems," Convention Paper 5582; Audio Engineering Society; May 10-13, 2002; pp. 1-11.
Horbach et al.: "Spatial Audio Reproduction Using Distributed Mode Loudspeaker Arrays," Conference Paper; Audio Engineering Society; Jun. 1-3, 2002; pp. 326-331.
Berkhout et al.: "Acoustic Control by Wave Field Synthesis," The Journal of the Acoustical Society of America; May 1993; pp. 2764-2774.
Corteel et al.: "Multichannel Inverse Filtering of Multiexciter Distributed Mode Loudspeakers for Wave Field Synthesis," Convention Paper 5611; Audio Engineering Society; May 10-13, 2002; pp. 1-5.

* cited by examiner

392

| loudspeaker | WFS scale | WFS delay |
|---|---|---|
| 1 | 0 | NA |
| 2 | 0 | NA |
| 3 | 0 | NA |
| 4 | 0.2 | 15ms |
| 5 | 0.7 | 12ms |
| 6 | 0.8 | 10ms |
| 7 | 0.3 | 14ms |
| 8 | 0 | 0 |
| 9 | 0 | 0 |
| 10 | 0 | 0 |

DEVICE AND METHOD FOR SIMULATION OF WFS SYSTEMS AND COMPENSATION OF SOUND-INFLUENCING PROPERTIES

BACKGROUND OF THE INVENTION

The present invention relates to wave field synthesis systems, and, in particular, to the aliasing correction in wave field synthesis systems.

There is an increasing need for new technologies and innovative products in the field of entertainment electronics. It is an important prerequisite for the success of new multimedia systems to offer optimal functionalities or capabilities. This is achieved by the employment of digital technologies and, in particular, computer technology. Examples for this are the applications offering an enhanced close-to-reality audiovisual impression. In previous audio systems, a substantial disadvantage lies in the quality of the spatial sound reproduction of natural, but also of virtual environments.

Methods of multi-channel loudspeaker reproduction of audio signals have been known and standardized for many years. All usual techniques have the disadvantage that both the site of the loudspeakers and the position of the listener are already impressed on the transfer format. With wrong arrangement of the loudspeakers with reference to the listener, the audio quality suffers significantly. Optimal sound is only possible in a small area of the reproduction space, the so-called sweet spot.

A better natural spatial impression as well as greater enclosure or envelope in the audio reproduction may be achieved with the aid of a new technology. The principles of this technology, the so-called wave field synthesis (WFS), have been studied at the TU Delft and first presented in the late 80s (Berkout, A. J.; de Vries, D.; Vogel, P.: Acoustic control by Wave field Synthesis. JASA 93, 993).

Due to this method's enormous demands on computer power and transfer rates, the wave field synthesis has up to now only rarely been employed in practice. Only the progress in the field of the microprocessor technology and the audio encoding do permit the employment of this technology in concrete applications today. First products in the professional field are expected next year. In a few years, first wave field synthesis applications for the consumer area are also supposed to come on the market.

The basic idea of WFS is based on the application of Huygens' principle of the wave theory:

Each point caught by a wave is starting point of an elementary wave propagating in spherical or circular manner.

Applied on acoustics, every arbitrary shape of an incoming wave front may be replicated by a large amount of loudspeakers arranged next to each other (a so-called loudspeaker array). In the simplest case, a single point source to be reproduced and a linear arrangement of the loudspeakers, the audio signals of each loudspeaker have to be fed with a time delay and amplitude scaling so that the radiating sound fields of the individual loudspeakers overlay correctly. With several sound sources, for each source the contribution to each loudspeaker is calculated separately and the resulting signals are added. If the sources to be reproduced are in a room with reflecting walls, reflections also have to be reproduced via the loudspeaker array as additional sources. Thus, the expenditure in the calculation strongly depends on the number of sound sources, the reflection properties of the recording room, and the number of loudspeakers.

In particular, the advantage of this technique is that a natural spatial sound impression across a great area of the reproduction space is possible. In contrast to the known techniques, direction and distance of sound sources are reproduced in a very exact manner. To a limited degree, virtual sound sources may even be positioned between the real loudspeaker array and the listener.

Although the wave field synthesis functions well for environments the properties of which are known, irregularities occur if the property changes or the wave field synthesis is executed on the basis of an environment property not matching the actual property of the environment.

The technique of the wave field synthesis, however, may also be advantageously employed to supplement a visual perception by a corresponding spatial audio perception. Previously, in the production in virtual studios, the conveyance of an authentic visual impression of the virtual scene was in the foreground. The acoustic impression matching the image is usually impressed on the audio signal by manual steps in the so-called postproduction afterwards or classified as too expensive and time-intensive in the realization and thus neglected. Thereby, usually a contradiction of the individual sensations arises, which leads to the designed space, i.e. the designed scene, to be perceived as less authentic.

In the technical publication "Subjective experiments on the effects of combining spatialized audio and 2D video projection in audio-visual systems", W. de Bruijn and M. Boone, AES convention paper 5582, May 10 to 13, 2002, Munich, subjective experiments with reference to effects of combining spatial audio and a two-dimensional video projection in audiovisual systems are illustrated. In particular, it is stressed that two speakers standing at differing distance to a camera and almost standing behind each other can be better understood by a viewer if the two people standing behind each other are seen and reconstructed as different virtual sound sources with the aid of the wave field synthesis. In this case, by subjective tests, it has turned out that a listener can better understand and distinguish the two speakers, who are talking at the same time, separately from each other.

In the audio field, by the technique of the wave field synthesis (WFS), good spatial sound for a large listener area can be accomplished. As it has been set forth, the wave field synthesis is based on the Huygens principle, according to which wave fronts may be shaped and built up by superimposition of elementary waves. According to a mathematically exact, theoretical description, an infinite number of sources in infinitely small distance would have to be used for the generation of the elementary waves. In practice, however, a finite number of loudspeakers is used in a finite, small distance to each other. Each of these loudspeakers is controlled with an audio signal from a virtual source having a certain delay and a certain level, according to the WFS principle. Levels and delays are usually different for all loudspeakers.

At is has already been set forth, the wave field synthesis system works on the basis of the Huygens principle and reconstructs a given waveform, for example, of a virtual source arranged at a certain distance to a show area or a listener in the show area by a multiplicity of individual waves. The wave field synthesis algorithm thus obtains information on the actual position of an individual loudspeaker from the loudspeaker array to then calculate, for this individual loudspeaker, a component signal this loudspeaker then finally has to irradiate, so that a superimposition of the loudspeaker signal from the one loudspeaker with the loudspeaker signals of the other active loudspeakers performs a reconstruction in that the listener has the impression that he or she is not "irradiated with sound" by many individual loudspeakers, but only by a single loudspeaker at the position of the virtual source.

For several virtual sources in a wave field synthesis setting, the contribution of each virtual source for each loudspeaker, i.e. the component signal of the first virtual source for the first loudspeaker, of the second virtual source for the first loudspeaker, etc., is calculated to then add the component signals to finally obtain the actual loudspeaker signal. In case of, for example, three virtual sources, the superimposition of the loudspeaker signals of all active loudspeakers at the listener would lead to the listener not having the impression that he or she is irradiated with sound from a large array of loudspeakers, but that the sound he or she is hearing only comes from three sound sources positioned at special positions, which are equal to the virtual sources.

In practice, the calculation of the component signals mostly takes place by the audio signal associated with a virtual source being imparted with a delay and a scaling factor at a certain time instant, depending on position of the virtual source and position of the loudspeaker, in order to obtain a delayed and/or scaled audio signal of the virtual source, which immediately represents the loudspeaker signal, when only one virtual source is present, or which then contributes to the loudspeaker signal for the loudspeaker considered, after addition with further component signals for the loudspeaker considered from other virtual sources.

Typical wave field synthesis algorithms work independently of how many loudspeakers are present in the loudspeaker array. The theory underlying the wave field synthesis consists in the fact that each arbitrary sound field may be exactly reconstructed by an infinitely high number of individual loudspeakers, the individual loudspeakers being arranged infinitely close to each other. In practice, however, neither the infinitely high number nor the infinitely close arrangement can be realized. Instead, there are a limited number of loudspeakers, which are additionally arranged in certain given distances to each other. With this, in real systems, only an approximation is achieved to the actual waveform that would take place if the virtual source was actually present, i.e. was a real source.

Due to loudspeaker array effects, a summation of the bass portions of 3 dB per octave, for example, occurs below an aliasing frequency. This amplification is a result of the sound wave superimpositions for basses in the WFS reproduction. For this reason, for the WFS reproduction below the aliasing frequency, a static filter correcting, i.e. lowering, the bass portion is calculated. This filter is calculated in dependence on the loudspeaker distance, and adjusting the aliasing frequency is currently made manually according to the auditory sensation of the sound monitoring operator.

It has been found that the manual adjustment is subjective and, thus, takes a lot of effort, and has further led to strong variations in the quality of the perceived tone.

In the technical publications by E. Corteel, U. Horbach, R. S. Pellegrini: "Multichannel Inverse Filtering of Multiexciter Distributed Mode Loudspeakers for Wave Field Synthesis", AES convention paper 5611, May 10-13, Munich, and U. Horbach, E. Corteel, D. de Vries: "Spatial Audio Reproduction using Distributed Mode Loudspeaker Arrays", AES conference paper, June 1-3, St. Petersburg, as well as the patent DE 103 21 986 relate to amplitudes, or a frequency manipulation, for quality improvements in the wave field synthesis.

SUMMARY

According to an embodiment, a device for aliasing correction in a wave field synthesis system with a wave field synthesis module and an array of loudspeakers for sound supply of a show area, wherein the wave field synthesis module is configured to receive an audio signal associated with a virtual sound source and source position information associated with the virtual sound source, and to calculate, taking into account loudspeaker position information, component signals for the loudspeakers due to the virtual sound source, may have: an ascertainer for ascertaining an aliasing filter property specific for a virtual sound source using the source position information, wherein the ascertainer for ascertaining is configured to acquire, for the loudspeakers in the array, wave field synthesis scaling values and wave field synthesis delay values associated with the loudspeakers, and to ascertain the aliasing filter property based on a listening point in the show area and the wave field synthesis scaling values and wave field synthesis delay values, and an adaptive anti-aliasing filter for adaptive filtering of the audio signal associated with the virtual sound source or the component signals associated with the virtual sound source, wherein the adaptive anti-aliasing filter is adjusted according to the aliasing filter property specific for the virtual sound source to effect an aliasing correction.

According to another embodiment, a method for aliasing filter correction in a wave field synthesis system with a wave field synthesis module and an array of loudspeakers for sound supply of a show area, wherein the wave field synthesis module is configured to receive an audio signal associated with a virtual sound source and source position information associated with the virtual sound source, and to calculate, taking into account loudspeaker position information, component signals for the loudspeakers due to the virtual sound source, may have the steps of: ascertaining aliasing filter properties specific for a virtual sound source using the source position information, wherein the ascertaining includes acquiring wave field synthesis scaling values and wave field synthesis delay values associated with the loudspeakers, so that the aliasing filter property is ascertained based on a listening point in the show area and the wave field synthesis scaling values and wave field synthesis delay values; and adaptive filtering of the audio signals associated with the virtual sound source or the component signals associated with the virtual sound source, wherein the adaptive filtering is performed according to the aliasing filter property specific for the source to effect an aliasing correction.

Another embodiment may have a computer program with a program code for performing the method for aliasing filter correction in a wave field synthesis system with a wave field synthesis module and an array of loudspeakers for sound supply of a show area, wherein the wave field synthesis module is configured to receive an audio signal associated with a virtual sound source and source position information associated with the virtual sound source, and to calculate, taking into account loudspeaker position information, component signals for the loudspeakers due to the virtual sound source, the method including: ascertaining aliasing filter properties specific for a virtual sound source using the source position information, wherein the ascertaining includes acquiring wave field synthesis scaling values and wave field synthesis delay values associated with the loudspeakers, so that the aliasing filter property is ascertained based on a listening point in the show area and the wave field synthesis scaling values and wave field synthesis delay values; and adaptive filtering of the audio signals associated with the virtual sound source or the component signals associated with the virtual sound source, wherein the adaptive filtering is performed according to the aliasing filter property specific for the source to effect an aliasing correction, when the computer program runs on a computer.

The present invention is based on the knowledge that aliasing correction in a wave field synthesis system is improved by ascertaining the aliasing filter property specific for a virtual source, using the source position information.

This aliasing filter property, which may be the aliasing frequency, for example, is ascertained by help of the source position information. This aliasing filter property is used for an adaptive anti-aliasing filter for adaptive filtering of the audio signal associated with the sources or the component signals associated with the sources.

In one embodiment of the present invention, a listening point in the reproduction space is selected, and the wave field synthesis module provides, for a virtual source, corresponding scaling and delay values for the single loudspeakers. Using the sound propagation laws, the amplitude value and the time value of the arrival of the impulse at the listening point are therefrom calculated for a particular impulse. The single impulses of the single loudspeakers do not arrive at the listening point at the same time, and instead deliver time signals and time values. These time signals are transformed to a spectral representation, from which the aliasing frequency is ascertained. This aliasing frequency marks the range between a fluctuating behavior of the spectral representation and a rising behavior to lower frequencies. This aliasing frequency now serves as an input for an anti-aliasing filter correcting, e.g. attenuating with 3 dB per octave, the level below the aliasing frequency.

An advantage of the inventive embodiments is that each virtual source is associated with an aliasing frequency. Thus, it is possible to dynamically filter moving virtual sources, too, and, thus, sound discolorations due to the motion are suppressed. In static filters used up till now, this is not possible, and, as a result, these static filters lead to a corruption of the sound upon a motion of the virtual sources. With an implementation of the aliasing filter in a computer system, here, filtering may be performed in real time to with the motion of the virtual sources. To save calculation time, in a further embodiment, the aliasing frequency may not be continuously calculated for all possible positions of the virtual source, but instead may be ascertained only for discrete points. These obtained aliasing frequencies may be incorporated into a table, for example, so that further calculations may be omitted. The quality achieved is given by the density of the discrete points.

A further advantage of the present invention is that the aliasing filtering may also be performed with respect to different listening points. By averaging these different aliasing frequencies associated with a virtual source, an averaged aliasing frequency may be ascertained for the entire listening room. This averaged aliasing frequency changes, in turn, with a change in the position of the virtual source, and may be corrected in dependence on the position of the virtual source, as previously described.

Thus, according to the invention, it is taken into account that the characteristic of this bass boost is dynamic and depends on different factors. For example, these are the loudspeaker density and the angle of incidence of the virtual sound sources.

The aliasing frequency changes with the positioning of the virtual sound sources and, thus, is dynamic. These dynamics are not taken into account in the current calculation. A significant disadvantage of previous WFS systems is that source motions are perceivable as changes in timbre. These are the result of the static filter and the dynamic change of the aliasing frequency and the bass boost. These changes in timbre are particularly significant if the virtual source is moving in parallel to the loudspeakers. A further disadvantage of the known art is that the different loudspeaker setups (with different loudspeaker distances) influence the aliasing frequency and the bass boost, which up to date has to be adjusted manually on the respective setup.

BRIEF DESCRIPTION OF THE DRAWINGS

Embodiments of the present invention will be detailed subsequently referring to the appended drawings, in which.

DETAILED DESCRIPTION OF THE INVENTION

Figure 7:
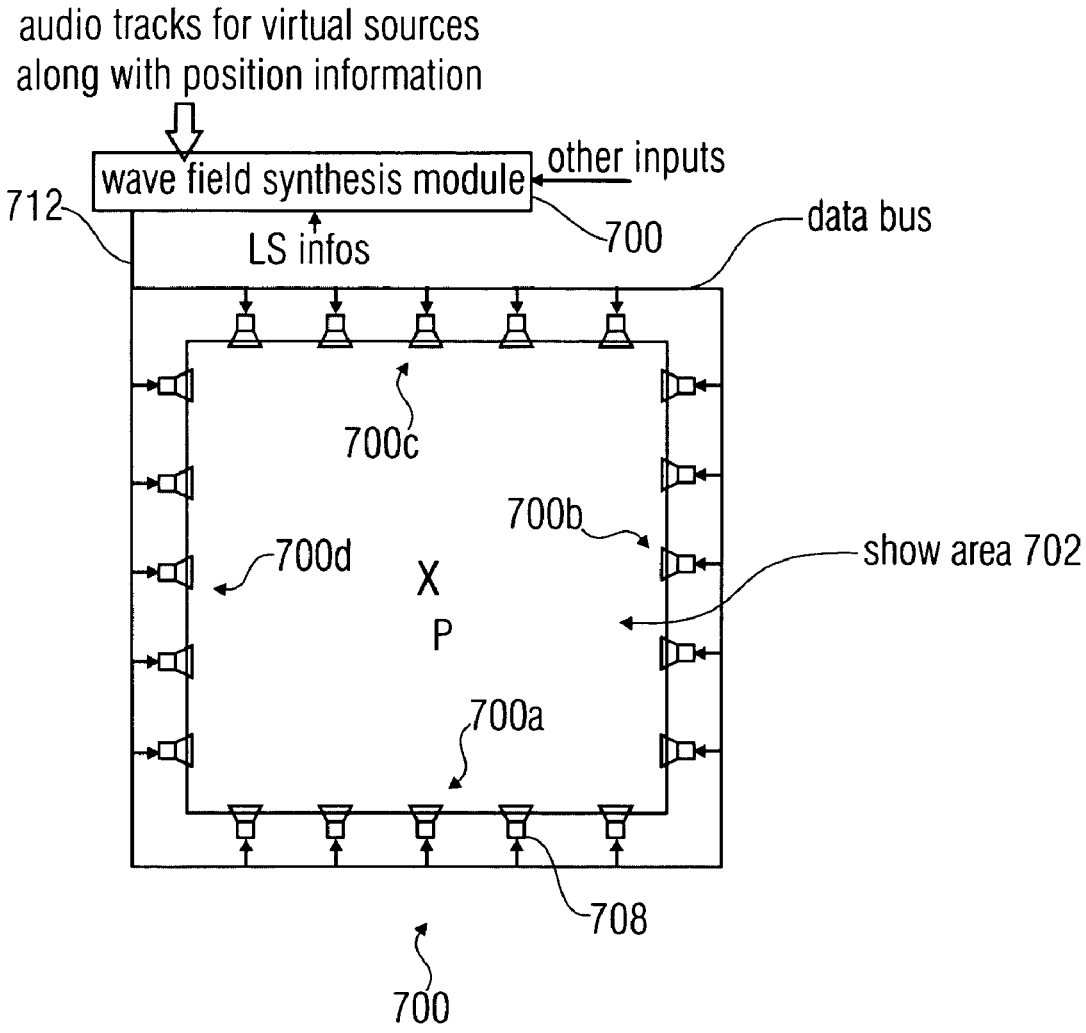
FIG. 7 is an elementary block circuit diagram of a wave field synthesis system with a wave field synthesis module and a loudspeaker array in a show area.

Before the present invention will be detailed, the elementary setup of a wave field synthesis system will be illustrated in the following with reference to FIG. 7. The wave field synthesis system has a loudspeaker array 700 placed with respect to a show area 702. In particular, the loudspeaker array shown in FIG. 7, which is a 360° array, includes four array sides 700*a*, 700*b*, 700*c* and 700*d*. If the show area 702 is a cinema, for example, then it will be assumed with respect to the conventions front/back or right/left that the cinema screen is located on the same side of the show area 702 at which the sub-array 700*c* is also arranged. In this case, the viewer sitting at the here so-called optimum point P in the show area 702 would look forward, that is, to the cinema screen. Behind the viewer, the sub-array 700*a* would be located, while to the left side of the viewer, the sub-array 700*d* would be located, and while to the right side of the viewer, the sub-array 700*b* would be located. Each loudspeaker array comprises a number of different single loudspeakers 708, which are each controlled with own loudspeaker signals provided from a wave field synthesis module 710 via a data bus 712 only schematically illustrated in FIG. 7. The wave field synthesis module is configured to calculate, using the information on the kind and length of the loudspeakers with respect to the show area 702, for example, that is, loudspeaker information (LS infos), and, if necessitated, other inputs, loudspeaker signals for the single loudspeakers 708, which are respectively derived according to the known wave field synthesis algorithms from the audio tracks for virtual sources which are further associated with position information. The wave field synthesis module may further obtain further inputs, such as information on the room acoustics of the show area etc.

The following explanations concerning the present invention may, in principle, be performed for each point p in the show area. The optimum point may thus lie at any location in the show area 702. Several optimum points, e.g. on an optimum line, may also be present. However, to obtain the best possible ratios for as many points as possible in the show area 702, it is advantageous to assume the optimum point, or the optimum line, in the middle, or at the center, of the wave field synthesis system defined by the loudspeaker sub-arrays 700*a*, 700*b*, 700*c*, 700*d*.

Figure 1A:
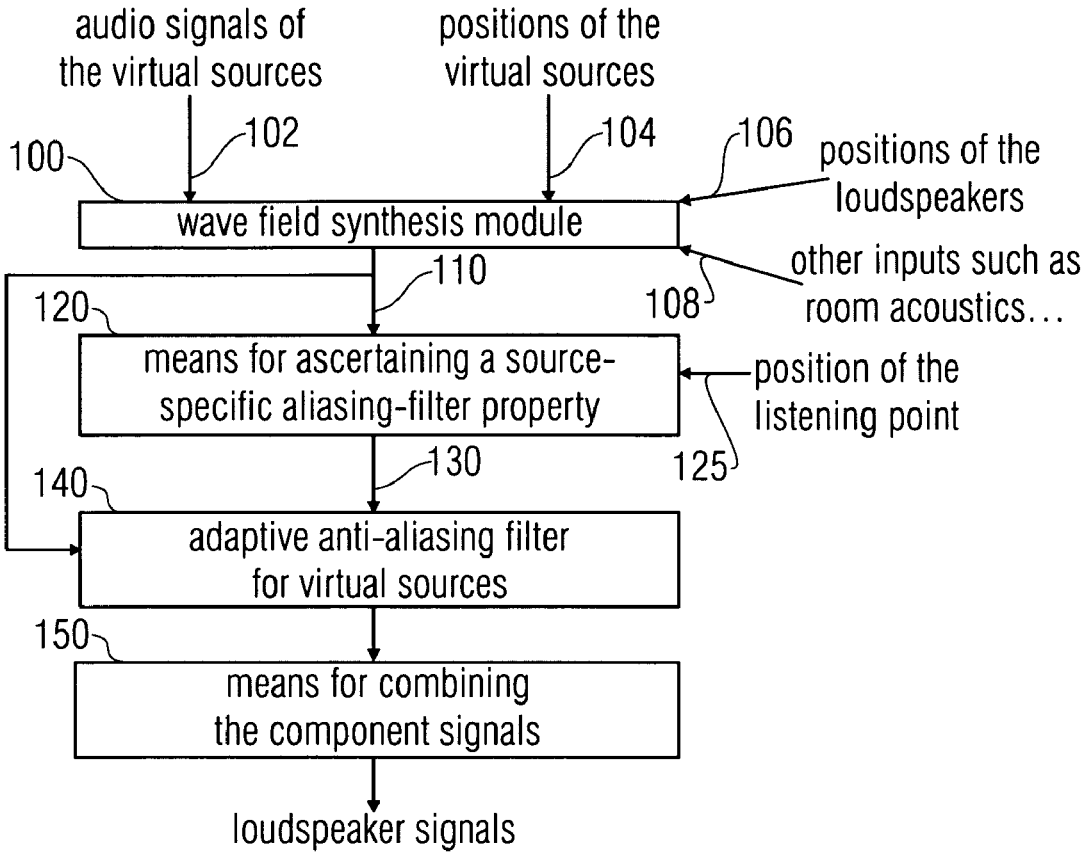
FIG. 1*a* is a block circuit diagram of the inventive device for aliasing filtration in a wave field synthesis system, wherein the component signals are filtered.

FIG. 1*a* shows a block circuit diagram of the inventive device for aliasing correction in a wave field synthesis system which has been set forth with reference to FIG. 7. The center of a wave field synthesis environment is a wave field synthesis module 100 possessing an input for the audio signals 102 of the virtual sources, an input for the position data 104 of the virtual sources, an input for the position data of the loudspeakers 106 and other inputs 108, if necessitated, providing information on the room acoustics, for example. In one output, the wave field synthesis module 100 provides both the component signals 110 and the corresponding delay and scaling values for the single loudspeakers. These data serve as input data of the means 120 for ascertaining a source-specific aliasing filter property (AFE) 130 which, beyond this, obtains the information on the position of the listening point 125, if necessitated. The aliasing filter property 130 and the component signals 110 serve as input signals for the adaptive anti-aliasing filter 140 for the virtual sources. After filtering the component signals 110, the corresponding loudspeaker signals 160 are compiled in a means for combining the component signals 150.

Figure 1B:
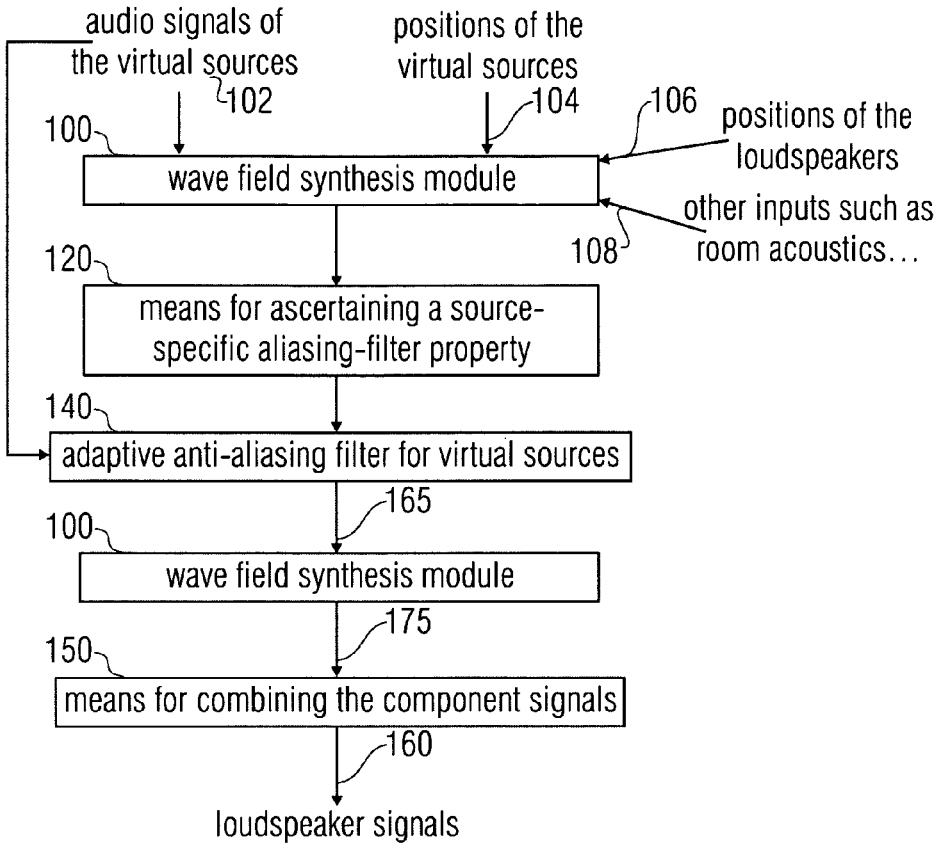
FIG. 1*b* is a block circuit diagram of the inventive device for aliasing filtration in a wave field synthesis system, wherein the audio signals associated with a virtual source are filtered.

In FIG. 1*b*, an inventive device is shown, in which not the component signals 110 are filtered by the adaptive anti-aliasing filter 140, but the audio signals 102 are filtered in the adaptive anti-aliasing filter 140 for virtual sources. The filtered audio signal 165 is input into the wave field synthesis module 100 to generate filtered component signals and to generate the corresponding loudspeaker signals 160 in the means 150 for combining the component signals.

Figure 2:
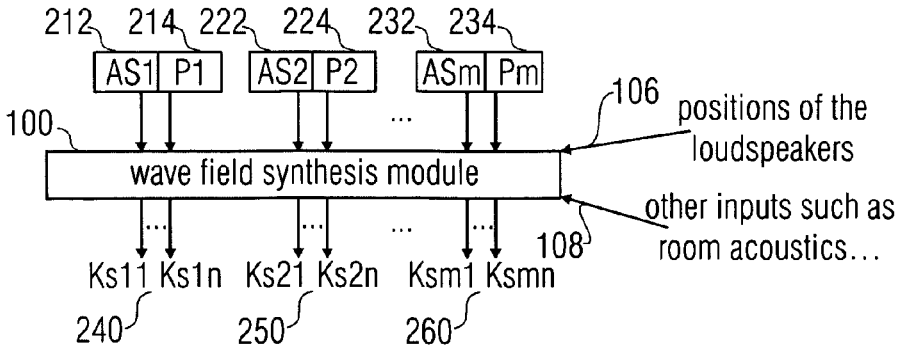
FIG. 2 is an elementary circuit diagram in a wave field synthesis environment, as may be employed for the present invention.

As is apparent from FIG. 2, the wave field synthesis module 100 obtains an audio signal and position information from each virtual source. The following is exemplarily shown in this figure: the audio signal of the first source 212 and the position of the first source 214, the audio signal of the second source 222 and the position information of the second source 224 as well as the audio signal of the last source 232 and the position information of the last source 234. Using the data on the position of the loudspeakers 106 as well as other inputs, such as the room acoustics 108, the wave field synthesis module 100 therefrom determines for each virtual source the component signals for each loudspeaker. The component signals of the first virtual source KS11 to KSn240, the second virtual source KS21 to KS2*n* 250 as well as the component signals of the last virtual source KSm1 to KSmn 260 are exemplarily shown.

Figure 3A:
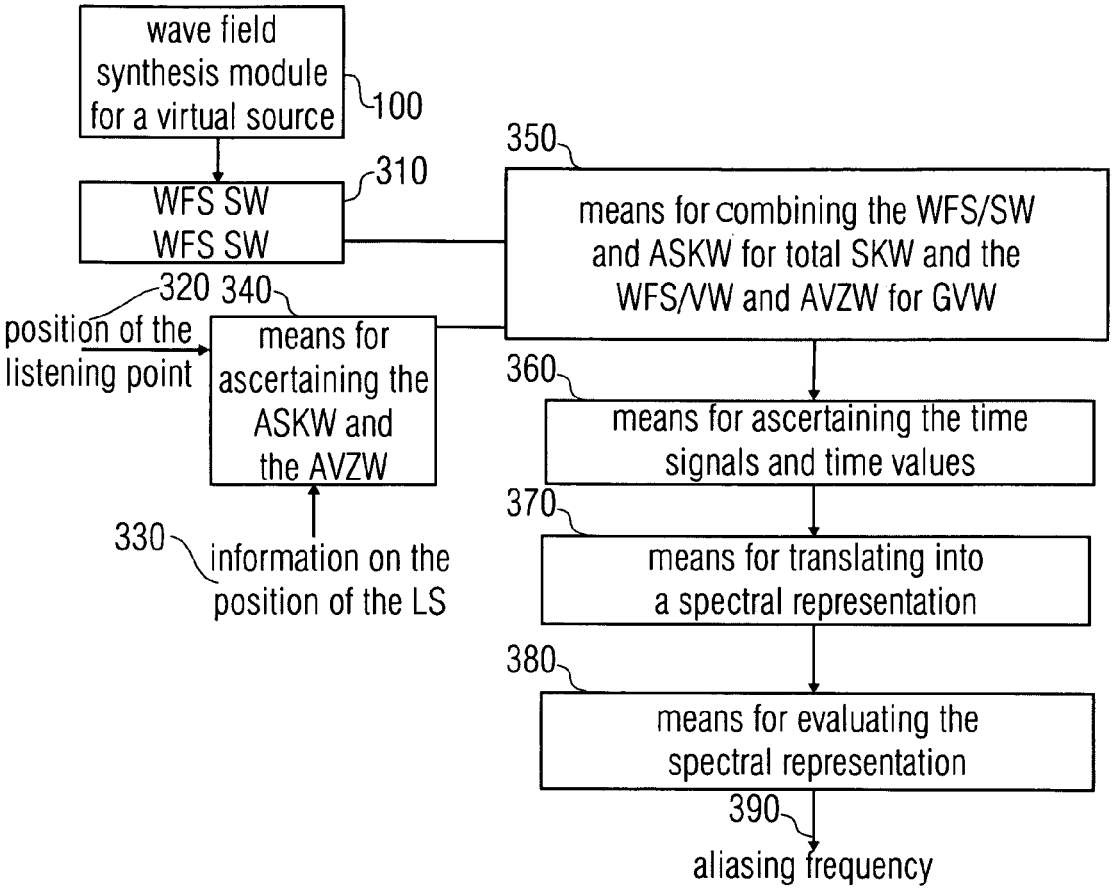
FIG. 3*a* is a block circuit diagram of an inventive means for ascertaining the aliasing frequency.

FIG. 3*a* shows a block circuit diagram of a device according to the invention for determining the aliasing frequency. The wave field synthesis module 100 generates a wave field synthesis scaling value (WFS SV) and a wave field synthesis delay value (WFS DV) 310 for a virtual source. From the position of the listening point 320 and the information on the position of the loudspeakers 330, a propagation delay value (PDV) and a propagation scaling value (PSV) are ascertained in the means 340. Together with the WFS SV and the WFS DV 310, these values serve as an input into the means 350 ascertaining both a total scaling value (TSV) and a total delay value (TDV). Therefrom, a time signal and corresponding time values are ascertained in the means 360, which is translated into a spectral representation in the means 370. Finally, in the means 380, this spectral representation is evaluated and a corresponding aliasing frequency 390 is determined.

Figure 3B:
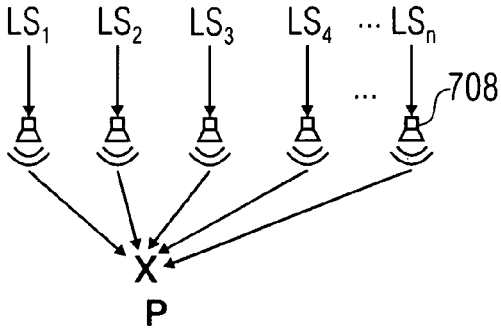
FIG. 3*b* is an outline for explaining the propagation delay value and propagation scaling value from the loudspeakers to the listening point.

In FIG. 3*b*, different loudspeakers 708 are shown, which are all fed with an own loudspeaker signal which has been generated by the wave field synthesis module 100. Thus, each loudspeaker may be modeled as a point wave outputting a concentric wave field. According to the laws of the concentric wave field, the level of the sound field decreases with the distance r to the loudspeakers, namely by the factor $1/r^2$. Thus, a dependence of 1/r results for the signal. Taking the propagation velocity of the soundwave into account, it may thereby be determined, with respect to the loudspeaker, when (propagation delay value) which signal arrives in which scaling (propagation scaling value) at the listening point P.

Figure 3C:
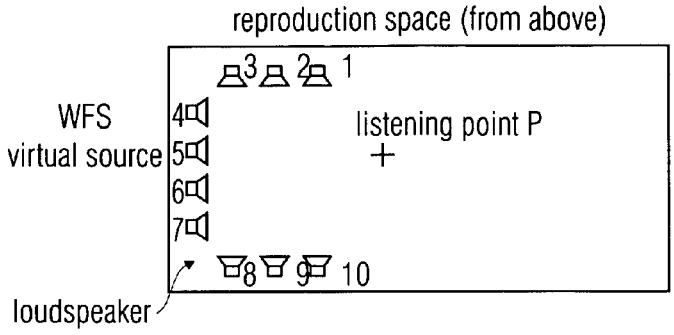
FIG. 3*c* is an example of 10 loudspeakers, where the scaling and delay values of the single loudspeakers are combined to a time signal at the listening point, from which the aliasing frequency is ascertained after the spectral representation.
Figure 3C:
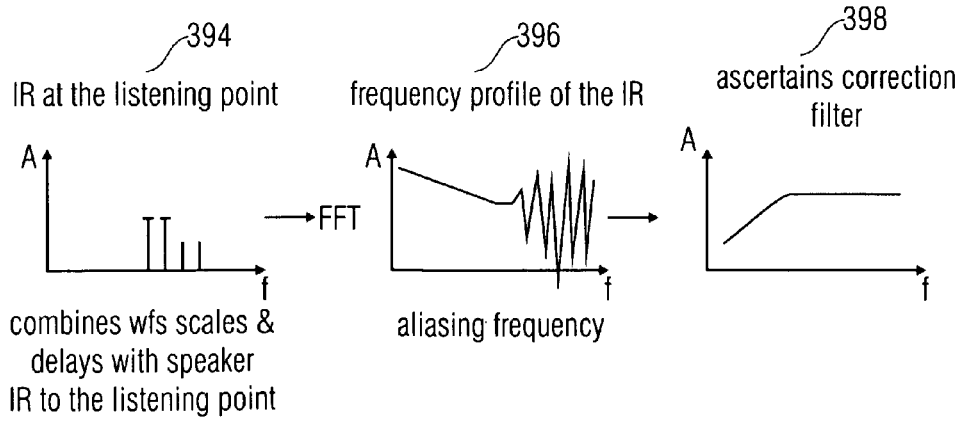

FIG. 3*c* shows a concrete example of a show area 702 with 10 loudspeakers of which the loudspeakers 4 to 7 radiate a signal of a virtual source with a particular scaling value and a particular delay value 392. After taking into account the time delay and the attenuation due to the propagation from the loudspeakers to the listening point P, a total delay value and a total scaling value is therefrom obtained for each loudspeaker at the listening point 394. If these total scaling values are plotted as time coordinates according to the total delay values, the time signal on the bottom left-hand side in FIG. 3*c* will result, which is designated as IR (impulse response) at the listening point. Here, the first signal with the smallest time value corresponds to the signal radiated from loudspeaker 6, which, according to table 392, has a scaling value of 0.8 and a delay value of 10 ms. The second signal in 394 is the signal from the loudspeaker 5, which, according to table 392, has a scaling value of 0.7 and a delay value of 12 ms. By analogy, then the signals from loudspeaker 4 and from loudspeaker 7 will follow, whose scaling and delay values are also indicated in table 394. This time signal is converted in a spectral representation 396, which is characterized by two regions. With respect to high frequencies, the spectral representation shows a fluctuating behavior, and with respect to lower frequencies, it shows a rising behavior. In the transitional region between the regions, the aliasing frequency is located. This aliasing frequency then serves as an input signal for a corresponding correction filter 398. This filter serves for causing a decrease of the bass portions by 3 dB per octave, for example.

Figure 4:
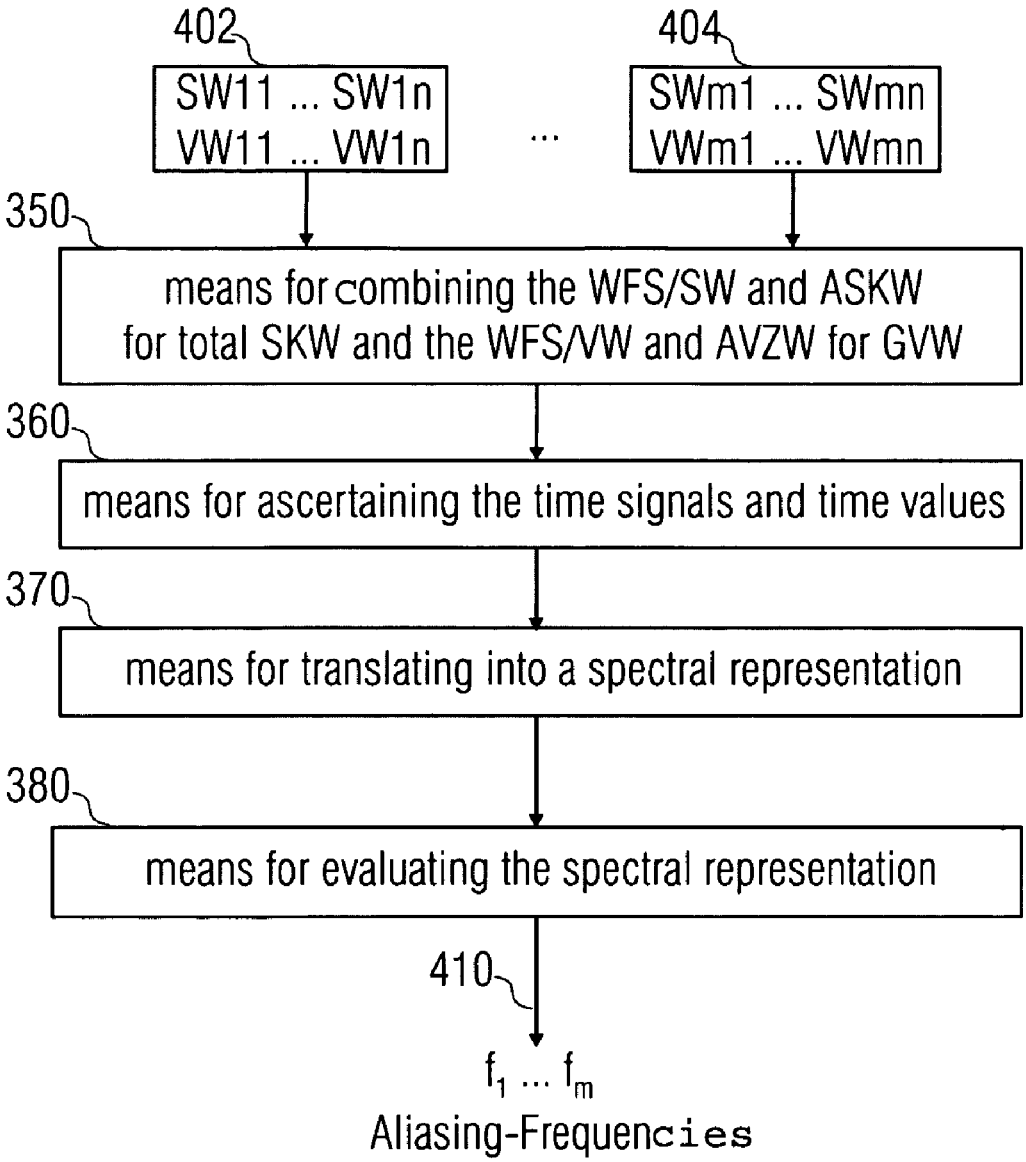
FIG. 4 is a block circuit diagram for ascertaining the aliasing frequencies corresponding to different virtual sources.

FIG. 4 shows a block circuit diagram in which ascertaining the aliasing frequencies for different virtual sources is shown. The wave field synthesis module 100 provides scaling and delay values for each virtual source and for each loudspeaker. In the example here shown, both the scaling and the delay values of the first virtual source 402 and the scaling and delay values of the last virtual source 404 are shown. By combining these values with the propagation delay values and the propagation scaling values, thus, a set of data is obtained for each virtual source which, in turn, serves as input signals for the means 350 for ascertaining the total scaling values and the total delay values. Therefrom, corresponding time signals and time values are separately ascertained in the means 360 for each virtual source, which, in turn, are transformed to a spectral representation in the means 370. These spectral representations will be evaluated in the means 380, so that aliasing frequencies 410 are obtained for each virtual source.

Figure 5:
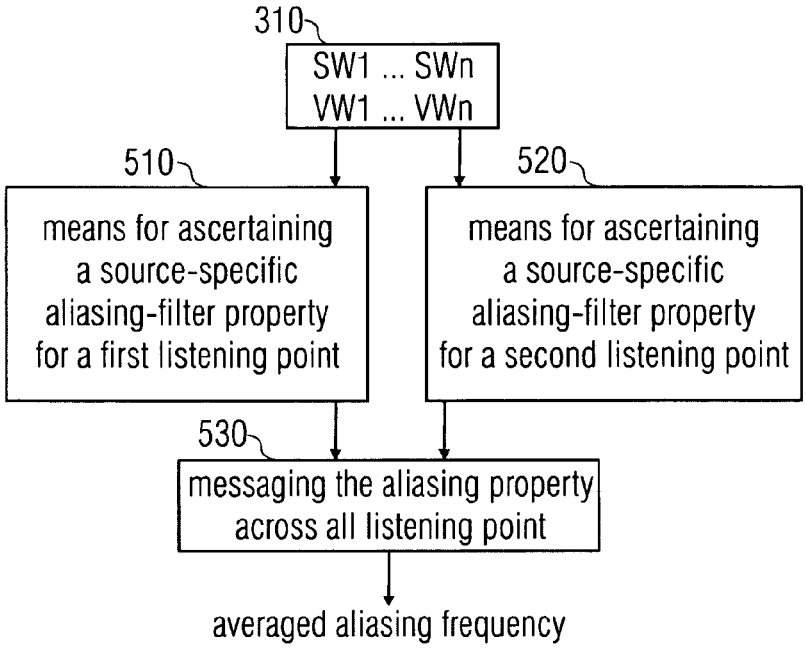
FIG. 5 is a block circuit diagram for averaging the aliasing filtering properties for different listening points.

FIG. 5 shows a block circuit diagram, in which aliasing frequencies are ascertained for each listening point and subsequently, an averaged aliasing frequency is determined via averaging. For this purpose, the scaling values and delay values 310 for a virtual source serve as input values for a means 510 for ascertaining a source-specific aliasing filter property for a first listening point, and also as input signals for a means for ascertaining a source-specific aliasing filter property for a second listening point 520. For each further listening point, the scaling and delay values are also ascertained in a corresponding means for ascertaining a source-specific aliasing filter property. The thus obtained filtering properties for each listening point are averaged in the means 530 across all listening points. Thus, an aliasing filter property is obtained for each virtual source for the entire listening area 702. This averaged aliasing filter property may be an averaged aliasing filtering frequency, for example.

Figure 6:
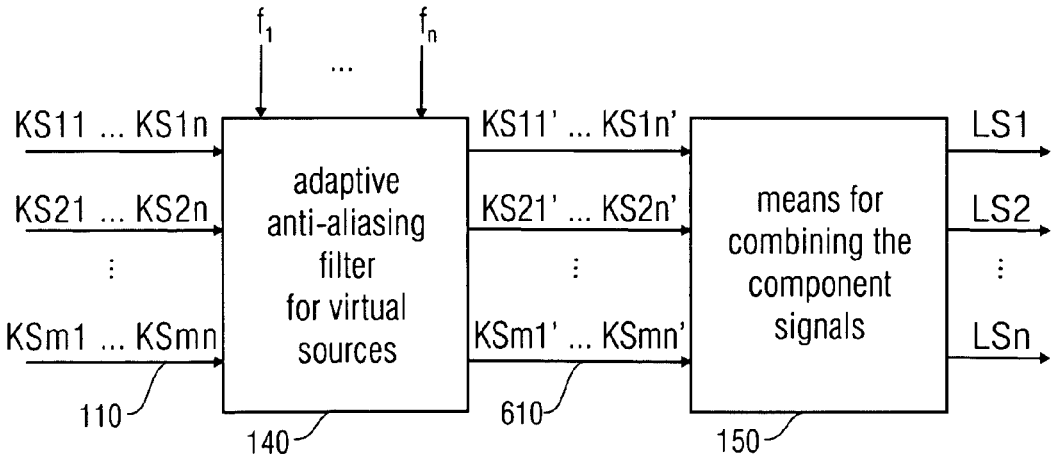
FIG. 6 is a block circuit diagram for an adaptive filter for several virtual sources.

FIG. 6 shows a block circuit diagram of an adaptive filter for virtual sources. The input signals of this adaptive filter 140 for virtual sources are both the aliasing frequencies $f_1$ to $f_n$ and the component signals 110, designated with KS11 to KS1*n* for the first virtual source, with KS21 to KS2*n* for the second virtual source, and with KSm1 to KSmn for the last virtual source. The output signals of the adaptive filter 140 are modified component signals 610 which, in turn, serve as an input for the means 150 for combining the component signals so as to finally provide the loudspeaker signals 160.

The aliasing frequency determined in this algorithm is the dynamically changing frequency below which a bass boost of 3 dB per octave, for example, develops in a WFS reproduction. Above this frequency, aliasing artefacts lead to frequency extinctions and comb filter effects. As already set forth, by an analysis of this frequency a dynamic filter is calculated, which compensates the bass boost in dependence on the source. In dependence on the loudspeaker setup used, this boost does not correspond to the theoretical value of 3 dB per octave. This dynamic correction filter is continuously updated in the case of source motions. The result is the optimum bass correction for the respective source position.

In the technical realization, the source position-dependent scaling and delay values of the signal are continuously determined for this purpose. From the knowledge of the current aliasing frequency, a correction filter is calculated and continuously updated (in dependence on the source position). The loudspeaker signals for this source are calculated by this correction filter. According to the invention, thus, an optimum sound is achieved for different loudspeaker setups, incorporating the source position-dependent aliasing frequency into the calculation of the loudspeaker signals. Thus, additionally, correction possibilities of the loudspeaker frequency response result by incorporating the loudspeaker parameters into the calculation. The incorporation as a plug-in into conventional simulation tools is also possible (e.g. in EASE). Equally, real sound field calculations may be made, incorporating the entire transmission chain (source position, WFS algorithm, loudspeaker parameters, room parameters, listening position).

Thus, to achieve a sound improvement in WFS systems, a complex impulse response is calculated in an embodiment, with knowledge of the position of a virtual sound source as well as of the loudspeakers and room parameters. With this impulse response, simulations and auralizations of WFS sound fields are possible. The system further provides information on the dynamic control of the compensation filter (3 dB filter) for the WFS. An optimized filter improves the sound quality of a WFS system.

Depending on the circumstances, the inventive schema may also be implemented in software. Implementation may occur on a digital storage medium, in particular a disc or CD with electronically readable control signals, which can interact with a programmable computer system such that the corresponding method is performed. Generally, the invention thus also consists in a computer program product with a program code, stored on a machine-readable carrier, for performing the method, when the computer program product runs on a computer. In other words, the invention may thus be realized as a computer program having a program code for performing the method when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A device for aliasing correction in a wave field synthesis system with a wave field synthesis module and an array of loudspeakers for sound supply of a show area, wherein the wave field synthesis module is configured to receive an audio signal associated with a virtual sound source and source position information associated with the virtual sound source, and to calculate, taking into account loudspeaker position information, component signals for the loudspeakers due to the virtual sound source, comprising:

an ascertainer for ascertaining an aliasing filter property specific for a virtual sound source using the source position information, wherein the ascertainer for ascertaining is configured to acquire, for the loudspeakers in the array, wave field synthesis scaling values and wave field synthesis delay values associated with the loudspeakers, and to ascertain the aliasing filter property based on a listening point in the show area and the wave field synthesis scaling values and wave field synthesis delay values,; and an adaptive anti-aliasing filter for adaptive filtering of the audio signal associated with the virtual sound source or the component signals associated with the virtual sound source, wherein the adaptive anti-aliasing filter is adjusted according to the aliasing filter property specific for the virtual sound source to effect an aliasing correction.

2. The device according to claim 1, wherein the ascertainer for ascertaining is configured to calculate the aliasing filter property using an impulse response for a channel between the virtual sound source and a listening point in the reproduction space.

3. The device according to claim 1, wherein the ascertainer for ascertaining is configured to ascertain propagation delay values and propagation scaling values between the loudspeakers and the listening point to combine the wave field synthesis delay value and the propagation delay value for each loudspeaker to acquire a total delay value, to combine the wave field synthesis scaling value and the propagation scaling value for each loudspeaker to acquire a total scaling value, and to ascertain an impulse response to the virtual sound source and the listening point using the total scaling values and the total delay values for the loudspeakers.

4. The device according to claim 3, wherein the ascertainer for ascertaining is configured to translate a time signal with time values the time coordinates of which are defined by the total delay values, and the amplitudes of which are defined by the total scaling values, into a spectral representation and to ascertain, from the spectral representation, an aliasing filter frequency as aliasing filter property.

5. The device according to claim 2, wherein the ascertainer for ascertaining is configured to ascertain, from a spectral representation of the impulse response, an aliasing filter frequency as aliasing filter property.

6. The device according to claim 4, wherein the ascertainer for ascertaining is configured to ascertain, as aliasing filter frequency, a frequency which is in a range limited, towards low frequencies, by an increase of the spectral representation, and limited, towards higher frequencies, by a fluctuation of the spectral representation.

7. The device according to claim 6, wherein the ascertainer for ascertaining is configured to select, as aliasing filter property, a frequency deviating by less than ±25% from a frequency value corresponding to a transitional value between an increase of the spectral representation and a fluctuation of the spectral representation.

8. The device according to claim 4, wherein the ascertainer for ascertaining is configured to ascertain, for a virtual sound source, aliasing filter properties for different listening points in the reproduction space, and to average the different aliasing filter properties to acquire the aliasing filter property specific for the virtual sound source.

9. The device according to claim 1, wherein the ascertainer for ascertaining is configured to calculate different aliasing filter properties for virtual sound sources at different virtual positions, and wherein the adaptive anti-aliasing filter is configured to filter the audio signals associated with the virtual sound sources or the component signals associated with the virtual sound sources using the different aliasing filter properties.

10. The device according to claim 9, wherein the adaptive anti-aliasing filter is configured to filter the audio signals associated with the virtual sound sources separately using the different aliasing filter properties to acquire aliasing-filtered audio signals, and wherein wave field synthesis module is configured to calculate the component signals for each virtual sound source using the filtered audio signals, and to combine component signals belonging to a loudspeaker to acquire a loudspeaker signal for the loudspeaker.

11. The device according to claim 9, wherein the adaptive anti-aliasing filter is configured to filter component signals calculated for a first virtual source using the anti-aliasing filter property specific for the first virtual source so as to acquire first aliasing-filtered component signals for the first virtual source and to acquire, for a second virtual source, second aliasing-filtered component signals for the second virtual source, wherein the wave field synthesis module is further configured to combine component signals, belonging to a loudspeaker, of the first aliasing-filtered component signals and the second aliasing-filtered component signals to acquire a loudspeaker signal for the loudspeaker.

12. A method for aliasing filter correction in a wave field synthesis system with a wave field synthesis module and an array of loudspeakers for sound supply of a show area, wherein the wave field synthesis module is configured to receive an audio signal associated with a virtual sound source and source position information associated with the virtual sound source, and to calculate, taking into account loudspeaker position information, component signals for the loudspeakers due to the virtual sound source, comprising:

ascertaining aliasing filter properties specific for a virtual sound source using the source position information, wherein the ascertaining comprises acquiring wave field synthesis scaling values and wave field synthesis delay values associated with the loudspeakers, so that the aliasing filter property is ascertained based on a listening point in the show area and the wave field synthesis scaling values and wave field synthesis delay values; and adaptive filtering of the audio signals associated with the virtual sound source or the component signals associated with the virtual sound source, wherein the adaptive filtering is performed according to the aliasing filter property specific for the source to effect an aliasing correction.

13. A computer readable medium storing a computer program with a program code for performing, when the computer programs runs on a computer, a method for aliasing filter correction in a wave field synthesis system with a wave field synthesis module and an array of loudspeakers for sound supply of a show area, wherein the wave field synthesis module is configured to receive an audio signal associated with a virtual sound source and source position information associated with the virtual sound source, and to calculate, taking into account loudspeaker position information, component signals for the loudspeakers due to the virtual sound source, the method comprising:

ascertaining aliasing filter properties specific for a virtual sound source using the source position information, wherein the ascertaining comprises acquiring wave field synthesis scaling values and wave field synthesis delay values associated with the loudspeakers, so that the aliasing filter property is ascertained based on a listening point in the show area and the wave field synthesis scaling values and wave field synthesis delay values; and adaptive filtering of the audio signals associated with the virtual sound source or the component signals associated with the virtual sound source, wherein the adaptive filtering is performed according to the aliasing filter property specific for the source to effect an aliasing correction.

* * * * *

UNITED STATES PATENT AND TRADEMARK OFFICE

CERTIFICATE OF CORRECTION

PATENT NO. : 8,363,847 B2
APPLICATION NO. : 12/279017
DATED : January 29, 2013
INVENTOR(S) : Deguara et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1179 days.

Signed and Sealed this
First Day of September, 2015

Michelle K. Lee

Michelle K. Lee
*Director of the United States Patent and Trademark Office*